US009675976B2

(12) United States Patent
Roozeboom et al.

(10) Patent No.: US 9,675,976 B2
(45) Date of Patent: Jun. 13, 2017

(54) HAMMER SUPPORT FOR ROTARY TOOL

(71) Applicant: Vermeer Manufacturing Company, Pella, IA (US)

(72) Inventors: Keith Leon Roozeboom, Pella, IA (US); Joseph Edward Breja, Pella, IA (US)

(73) Assignee: VERMEER MANUFACTURING COMPANY, Pella, IA (US)

( * ) Notice: Subject to any disclaimer, the term of this patent is extended or adjusted under 35 U.S.C. 154(b) by 428 days.

(21) Appl. No.: 14/313,368

(22) Filed: Jun. 24, 2014

(65) Prior Publication Data

US 2015/0069160 A1 Mar. 12, 2015

Related U.S. Application Data

(60) Provisional application No. 61/875,920, filed on Sep. 10, 2013.

(51) Int. Cl.

| | |
|---|---|
| ***B02C 13/06*** | (2006.01) |
| ***B02C 13/28*** | (2006.01) |
| ***B02C 18/18*** | (2006.01) |
| ***B02C 18/14*** | (2006.01) |

(52) U.S. Cl.

CPC ..... *B02C 13/2804* (2013.01); *B02C 13/06* (2013.01); *B02C 18/14* (2013.01); *B02C 18/18* (2013.01); *Y10T 29/49947* (2015.01)

(58) Field of Classification Search

CPC ..... B02C 13/2804; B02C 18/14; B02C 13/06; B02C 18/18; Y10T 29/49947

USPC ..... 241/294

See application file for complete search history.

(56) References Cited

U.S. PATENT DOCUMENTS

| | | | |
|---|---|---|---|
| 223,689 | A | 1/1880 | Adams |
| 567,046 | A | 9/1896 | Rice |
| 750,329 | A | 1/1904 | Windingstad |
| 1,010,645 | A | 12/1911 | Lane |
| 1,565,842 | A | 12/1925 | Aram |
| 1,951,101 | A | 3/1934 | Miller |
| 2,221,002 | A | 11/1940 | Mankoff |
| 2,557,865 | A | 6/1951 | Emmanouilidis |

(Continued)

FOREIGN PATENT DOCUMENTS

| | | | |
|---|---|---|---|
| CN | 102615686 | A | 8/2012 |
| DE | 1 815 599 | A1 | 7/1970 |

(Continued)

OTHER PUBLICATIONS

International Search Report and Written Opinion for Application No. PCT/US2014/054954 mailed Dec. 15, 2014.

(Continued)

*Primary Examiner* — Mark Rosenbaum
(74) *Attorney, Agent, or Firm* — Merchant & Gould P.C.

(57) ABSTRACT

A hammer support system for a rotary tool has a hammer receiver including a first alignment opening having a first curved alignment surface. A first wedge part has a curved surface, and a second wedge part is configured to interact with the first wedge part. A fastener is provided for drawing down the first wedge part against the second wedge part such that the curved surface of the first wedge part engages the first curved alignment surface to self-align the first and second wedge parts as the first wedge part is drawn down by the fastener.

19 Claims, 8 Drawing Sheets

(56) References Cited

U.S. PATENT DOCUMENTS

| | | | |
|---|---|---|---|
| 2,814,854 | A | 12/1957 | Murray |
| 2,836,206 | A | 5/1958 | Gaskell |
| 2,958,474 | A | 11/1960 | Meyer |
| 3,140,749 | A | 7/1964 | Dionisotti |
| 3,170,643 | A | 2/1965 | Hanse et al. |
| 3,380,672 | A | 4/1968 | Weispfenning |
| 3,650,484 | A | 3/1972 | Kimble et al. |
| 3,758,035 | A | 9/1973 | Ushiku et al. |
| 3,790,216 | A | 2/1974 | Peterson |
| 3,831,842 | A | 8/1974 | Tamura |
| 3,865,164 | A | 2/1975 | Sybertz |
| 4,009,742 | A | 3/1977 | Ziegelmeyer |
| 4,068,694 | A | 1/1978 | Schmidt et al. |
| 4,114,817 | A | 9/1978 | Harris |
| 4,131,047 | A | 12/1978 | Schriber et al. |
| 4,405,092 | A | 9/1983 | Sybertz et al. |
| 4,487,532 | A | 12/1984 | Hamilton |
| 4,679,740 | A | 7/1987 | Orphall |
| 4,744,278 | A | 5/1988 | Wright |
| 4,819,703 | A | 4/1989 | Rice et al. |
| 4,821,970 | A | 4/1989 | Puetz |
| 5,005,913 | A | 4/1991 | Kittle et al. |
| 5,060,874 | A | 10/1991 | Sidney, Jr. et al. |
| 5,114,085 | A | 5/1992 | Inui |
| 5,240,192 | A | 8/1993 | Tilby et al. |
| 5,320,292 | A | 6/1994 | Smith |
| 5,377,919 | A | 1/1995 | Rogers et al. |
| 5,419,502 | A | 5/1995 | Morey |
| 5,526,988 | A | 6/1996 | Rine |
| 5,529,249 | A | 6/1996 | Braun et al. |
| 5,950,942 | A | 9/1999 | Brand et al. |
| 6,079,649 | A | 6/2000 | Balvanz et al. |
| 6,142,400 | A | 11/2000 | Balvanz et al. |
| 6,260,638 | B1 | 7/2001 | Massa et al. |
| 6,311,910 | B1 | 11/2001 | Balvanz et al. |
| 6,364,227 | B1 | 4/2002 | Dorscht |
| 6,394,378 | B1 | 5/2002 | Ragnarsson |
| 6,422,495 | B1 | 7/2002 | De Boef et al. |
| 6,840,471 | B2 | 1/2005 | Roozeboom et al. |
| 7,204,442 | B2 | 4/2007 | Roozeboom et al. |
| 7,213,779 | B2 | 5/2007 | Roozeboom et al. |
| 7,293,729 | B2 | 11/2007 | Ragnarsson |
| 7,448,567 | B2 | 11/2008 | Roozeboom et al. |
| 7,810,531 | B2 | 10/2010 | Labbé |
| 7,959,097 | B2 | 6/2011 | De Boef |
| 7,959,099 | B1 | 6/2011 | Cox et al. |
| 8,061,640 | B2 | 11/2011 | Cotter et al. |
| 8,113,453 | B2 | 2/2012 | Bardos |
| 8,267,341 | B2 | 9/2012 | Pallmann |
| 2001/0045478 | A1 | 11/2001 | Recker et al. |
| 2002/0125353 | A1 | 9/2002 | Bardos et al. |
| 2002/0190148 | A1 | 12/2002 | Roozeboom et al. |
| 2003/0127550 | A1* | 7/2003 | Stemper ..... B02C 13/2804 241/294 |
| 2011/0226880 | A1 | 9/2011 | Marquardsen |

FOREIGN PATENT DOCUMENTS

| | | | |
|---|---|---|---|
| DE | 32 11 648 | A1 | 10/1983 |
| DE | 85 20 900 | U1 | 9/1985 |
| DE | 43 38 331 | A1 | 5/1995 |
| DE | 10 2009 022 454 | A1 | 12/2010 |
| DE | 20 2012 000 643 | U1 | 6/2013 |
| EP | 1 201 310 | A1 | 5/2002 |
| EP | 1 358 022 | B1 | 7/2005 |
| EP | 1 715 955 | | 11/2006 |
| EP | 2 399 673 | B1 | 2/2013 |
| GB | 21776 | | 0/1898 |
| GB | 172898 | | 12/1921 |
| GB | 311913 | | 5/1929 |
| GB | 468581 | | 7/1937 |
| GB | 469343 | | 7/1937 |
| GB | 595187 | | 11/1947 |
| GB | 719194 | | 11/1954 |
| JP | 2001-190972 | A | 7/2001 |
| WO | WO 2006/114223 | A1 | 11/2006 |
| WO | WO 2008/086208 | A2 | 7/2008 |
| WO | WO 2011/113149 | A1 | 9/2011 |
| WO | WO 2011/161583 | A1 | 12/2011 |

OTHER PUBLICATIONS

Supplementary European Search Report for Application No. 14 83 7089 Date of Completion of the Search Apr. 5, 2016.

* cited by examiner

HAMMER SUPPORT FOR ROTARY TOOL

CROSS REFERENCE TO RELATED APPLICATIONS

This application claims the benefit of U.S. Provisional Application No. 61/875,920, filed Sep. 10, 2013, and titled "Hammer Support for Rotary Tool," the disclosure of which is hereby incorporated herein by reference.

BACKGROUND

The present disclosure relates generally to rotary tools such as rotary grinders for grinding or shredding material, such as waste material. Waste material such as trees, brush, stumps, pallets, railroad ties, peat moss, paper, wet organic materials and the like are often processed with hammermill machines that generally fall into one of two categories: grinders or shredders. Grinders typically function by forcing the material into contact with a rotating member such as a drum having cutters at the outer diameter. The cutters of grinders travel at a relatively high rate of speed, typically exceeding 5000 feet per minute. Shredders typically function by forcing the material into contact with a rotating drum with cutters at the outer diameter. The cutters of shredders travel at a relatively low rate of speed, typically less than 500 feet per minute.

In both types of hammermill machines, the cutters are subjected to extreme loads. Although the loading differs, due to the differing speeds, the cutters must be securely attached to the rotating member. Further, the cutters in either machine can experience high rates of wear, particularly if the waste material is abrasive. For this reason the cutters are typically replaceable.

Improvements in rotary tools are desired.

SUMMARY

In accordance with aspects of the present disclosure, an example rotary tool has a rotatable member including a receiving aperture with a first side and a second side. A hammer is positioned in the receiving aperture and has a first side and a second side. A first self-aligning support member is positioned between the first side of the receiving aperture and the first side of the hammer. A second self-aligning support member is positioned between the second side of the receiving aperture and the second side of the hammer.

In certain embodiments, at least one of the first and second self-aligning support members includes a wedge arrangement for clamping the hammer within the receiving aperture. The wedge arrangement includes a fastener for drawing down a component of the wedge arrangement to clamp the hammer within the receiving aperture. The wedge arrangement also includes a curved interface for self-aligning the wedge arrangement as the component is drawn down by the fastener.

In some examples the rotary tool further includes a hammer receiver including a first alignment opening, with the first self-aligning support member is received in the first alignment opening. The first alignment opening has a first alignment surface and the first self-aligning support member has a second alignment surface that contact one another. In some implementations, the first and second alignment surfaces are curved.

In accordance with further aspects of the present disclosure, an example hammer support system has a hammer receiver including a first alignment opening having a first curved alignment surface. A first wedge part has a curved surface, and a second wedge part is configured to interact with the first wedge part. A fastener is provided for drawing down the first wedge part against the second wedge part such that the curved surface of the first wedge part engages the first curved alignment surface to self-align the first and second wedge parts as the first wedge part is drawn down by the fastener.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as top, bottom, front, back, etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense.

Figure 1:
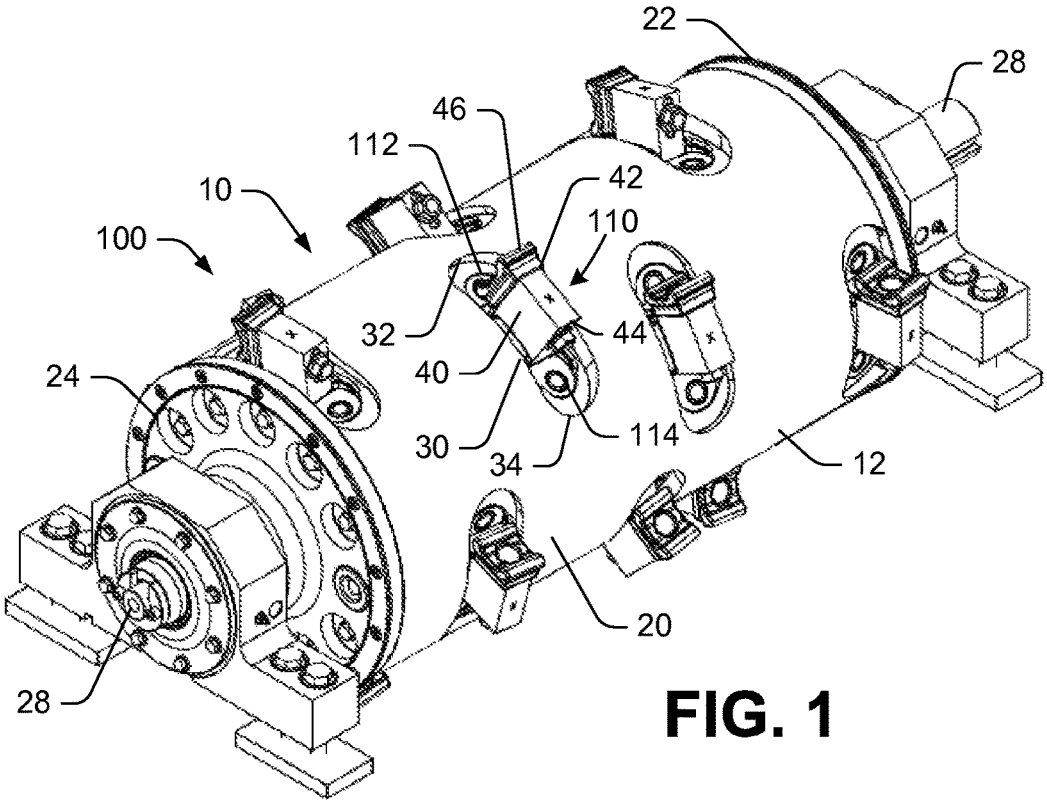
FIG. 1 is a perspective view illustrating an example of a rotary tool in accordance with aspects of the present disclosure.
Figure 2:
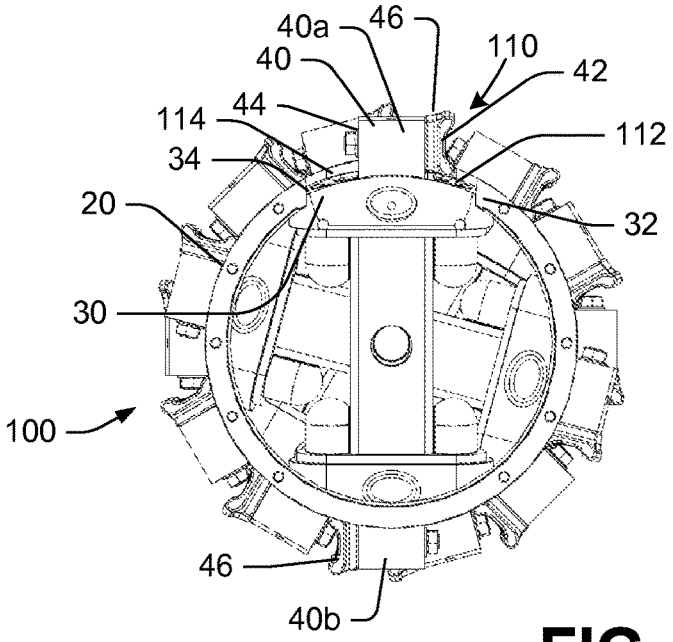
FIG. 2 is an end view of the rotary tool shown in FIG. 1 with an end cap removed.

FIGS. 1 and 2 illustrate an example of a rotary tool 100, such as a grinder or material reduction machine in accordance with aspects of the present disclosure. The rotary tool 100 includes a rotatable member 10. In the example shown in FIG. 1, the rotatable member 10 is a rotary drum 12 that has a generally cylindrical drum skin 20, and first and second end caps 22, 24 positioned at opposite ends of the drum skin 20. Each of the end caps 22, 24 includes a stub shaft 28 (the end cap 22 is not shown in FIG. 2). In some examples, the end caps 22,24 are bolted to the end of the drum 20 and bearings are attached to them. In other embodiments, a cylindrical through shaft or a shaft with a non-circular cross-section, such as a hexagon shape is received by the end caps 22,24.

The drum skin 20 defines a plurality of hammer receiving apertures 30, with a hammer 40 received therein. Each of the receiving apertures 30 has first and second sides 32, 34. The hammer 40 also has a first (leading) side 42 and a second (trailing) side 44. Typical known grinders use rectangular wedging components to hold the hammer in position. However, known wedging arrangements include several surfaces that need to be in alignment, parallel to one another, to satisfactorily wedge the hammer in place. Such surfaces in prior art devices are rarely truly parallel, complicating perfect alignment of the wedge parts and thus the desired secure clamping of the hammer in the hammer receiving apertures.

In certain disclosed embodiments, a hammer support system 110 is provided that includes a first self-aligning support member 112 positioned between the first side 32 of the receiving aperture 30 and the first side 42 of the hammer 40. A second self-aligning support member 114 is positioned between the second side 34 of the receiving aperture 30 and the second side 44 of the hammer 40.

In the example shown in FIGS. 1 and 2, the receiving apertures 30 are arranged in pairs, such that each receiving aperture 30 has a corresponding receiving aperture 30 located on the opposite side of the drum skin 20. The hammer 40 extends through the drum 12 such that opposite ends 40*a*, 40*b* of the hammer 40 project from the receiving apertures 30. In the illustrated embodiment, the leading sides 42 of the hammers 40 have a cutter 46 attached thereto.

Figure 3:
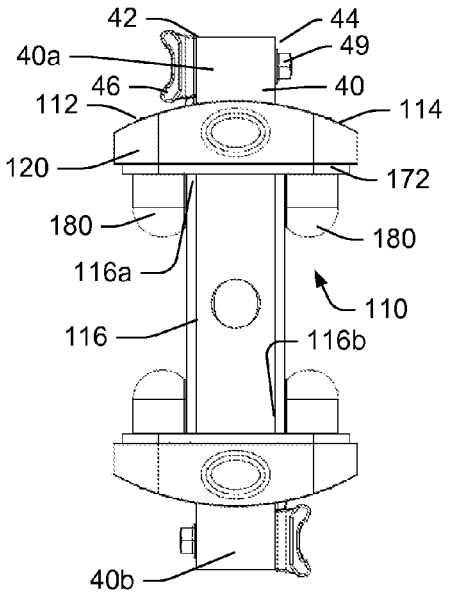
FIG. 3 is a side view illustrating an example of a hammer and hammer support system in accordance with aspects of the present disclosure.
Figure 4:
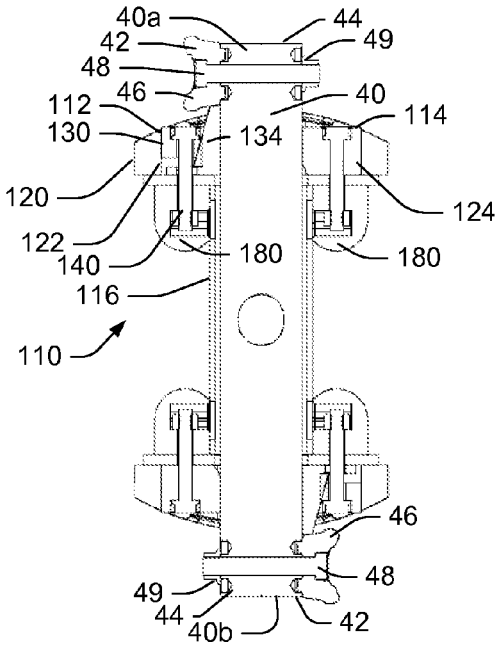
FIG. 4 is a section view of the hammer and hammer support system shown in FIG. 3.

FIGS. 3 and 4 illustrate a hammer support system including one of the hammers 40 removed from the drum 10 shown in FIG. 1, and further illustrate an example of the hammer support system 110. The hammer support system 110 includes a hammer receiver 120 that has first and second alignment openings 122, 124. In the illustrated examples, the first alignment opening 122 is positioned on the first 42, or leading side of the hammer 40, and the second alignment opening 124 is positioned on the second 44, or trailing side of the hammer 40. A sleeve 116 is attached to the hammer receiver 120, and the hammer 40 is received in the sleeve 116. As noted above, the embodiment shown in FIG. 1 includes hammers 40 that extend through the drum. As shown in FIG. 3, one end 116*a* of the sleeve 116 is connected to one hammer receiver 120 with the first end 40*a* of the hammer 40 extending therefrom, and the opposite end 116*b* of the sleeve 116 is connected to another hammer receiver 120 that is situated in a receiving aperture 30 on the opposite side of the drum 12, with the second end 40*b* of the hammer 40 extending therefrom. Each end 40*a*,40*b* of the hammer 40 has a cutter 46 attached to its leading side 42. In some embodiments, the cutter 46 is attached to the hammer 40 with a bolt 48 and nut 49.

Figure 5:
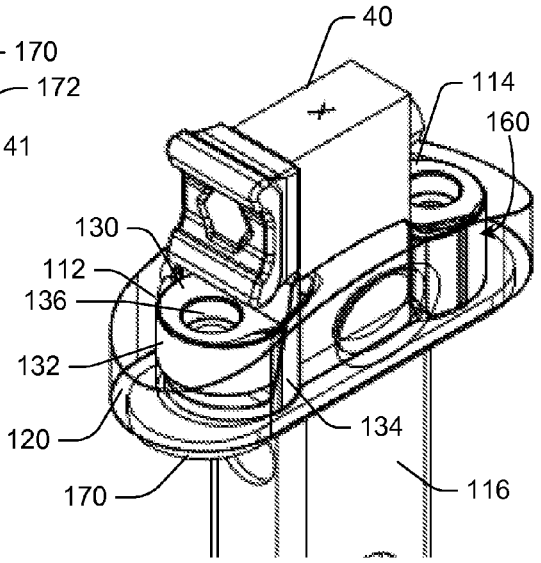
FIG. 5 is a close-up perspective view illustrating portions of the hammer and hammer support system shown in FIGS. 3 and 4.

The first self-aligning support member 112 is received in the first alignment opening 122 and the second self-aligning support member 114 is received in the second alignment opening 124. FIG. 5 is a perspective view showing the first end 40*a* of the hammer 40 extending from the hammer receiver 120. In FIG. 5, the hammer receiver 120 is transparent to show the first and second self-aligning support members 112,114 received therein.

Figure 7:
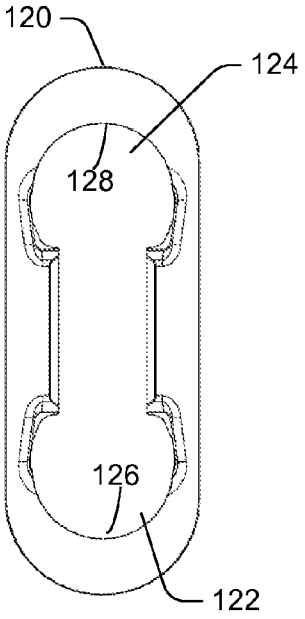
FIG. 7 is a top view of an example of a hammer receiver of the hammer support system shown in FIGS. 3-5.
Figure 8:
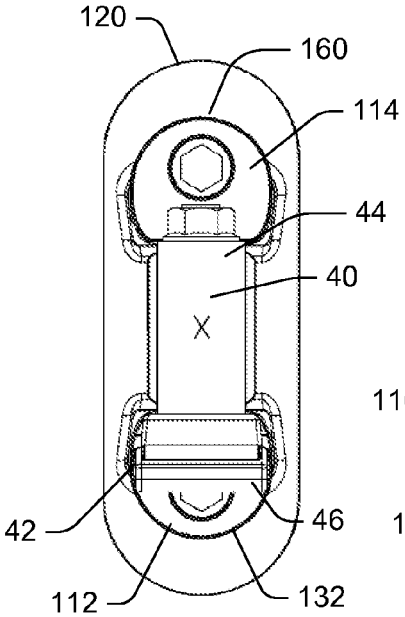
FIG. 8 is a top view of the hammer receiver of FIG. 7, further illustrating examples of a hammer and self-aligning support members received therein.
Figure 9:
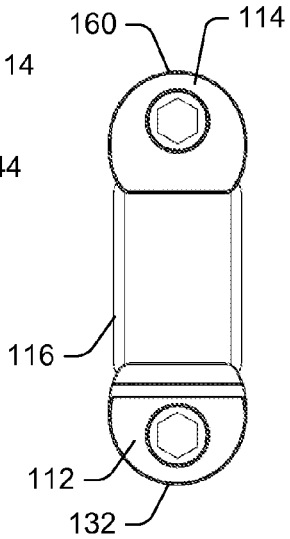
FIG. 9 is a top view of the self-aligning support members shown in FIG. 8.

FIG. 7 is a top view of an example of the hammer receiver 120. The first alignment opening 122 of the illustrated hammer receiver 120 has a first alignment surface 126 that is curved. The top view of FIG. 8 shows the first and second self-aligning support members 112,114 situated respectively in the first and second alignment openings 122,124 of the hammer receiver 120, and FIG. 9 shows the first and second self-aligning support members 112,114 with the sleeve 116 therebetween.

Figure 6:
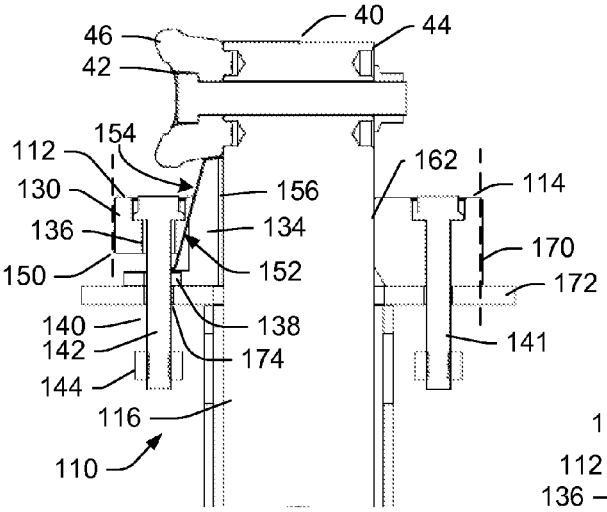
FIG. 6 is a section view illustrating portions of the hammer and hammer support system shown in FIGS. 3-5.

In some embodiments, the first self-aligning support member 112 includes a first wedge part 130 having a second alignment surface 132 that is curved, and a second wedge part 134 that is configured to interact with the first wedge part 130. FIG. 6 is a sectional view showing the hammer 40 and the hammer support system 110 with portions of the hammer receiver 120 removed to better illustrate the first and second wedge parts 130,134, among other things. A fastener 140 draws down the first wedge part 130 against the second wedge part 134 such that the curved surface 132 of the first wedge part 130 engages the first curved alignment surface 126 so as to pivot into alignment relative to one another and thus self-align the first and second wedge parts 130,134 as the first wedge part 130 is drawn down by the fastener 140. Thus, the first alignment surface 126 of the first alignment opening 122 matingly contacts the second alignment surface 132 to self-align the support member 112. The first alignment surface 126 and the second alignment surface 132 may have any curved or arcuate (e.g., semicircular, etc.) profile that allows the two to match/mate and thereby be able to pivotally self-align when drawn into contact with one another.

Figure 10:
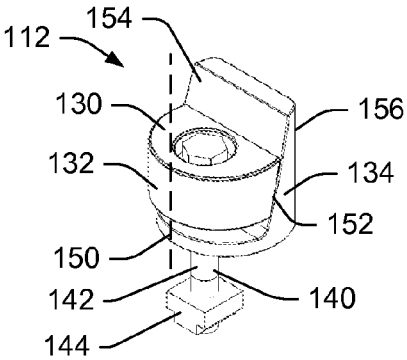
FIG. 10 is a perspective view illustrating examples of some components of a self-aligning support member.
Figure 12:
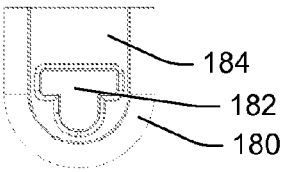
FIG. 12 is a front view illustrating an example of a nut retainer of the hammer support system shown in FIGS. 3 and 4.
Figure 13:
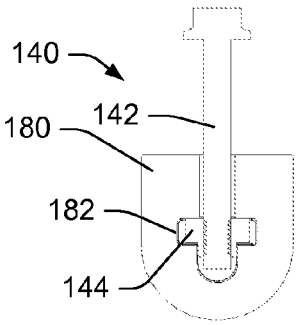
FIG. 13 is a section view illustrating an example of a fastener of the hammer support system shown in FIGS. 3 and 4.

In some examples, such as that shown in FIGS. 6 and 10, the curved surface 132 of the first wedge part 130 defines a projection line 150 extending generally parallel with a longitudinal axis of the hammer 40. In other words, the outer surface 132 of the first wedge part 130 extends parallel to the hammer 40 as shown in FIG. 6. The first wedge part 130 further includes a planar surface 152 that is angled relative to the projection line 150 of the curved surface 132. In other words, the planar surface 152 does not extend parallel to the projection line 150. The second wedge part 134 has a planar surface 154 that is configured to mate with the planar surface 152 of the first wedge part 130. The second wedge part 134 also has a second side 156 that is configured to mate with the first side 42 of the hammer 40.

As noted above, the second self-aligning support member 114 is received in the second alignment opening 124 of the hammer receiver 120. A fastener 141 holds the second self-aligning support member 114 in place in the second alignment opening 124. In some examples, the second self-aligning support member 114 has a third alignment surface 160, and the second alignment opening 124 has fourth alignment surface 128 that contacts the third alignment surface 160. In the illustrated example, the third alignment surface 160 of the second self-aligning support member 114 is curved and defines a projection line 170 extending generally parallel with the longitudinal axis of the hammer 40 and the projection line 150 of the curved surface 132. The second self-aligning support member 114 further has a planar surface 162 that extends generally parallel with the projection line 170 of the curved alignment surface 160. This planar surface 162 is configured to mate with the second side 44 of the hammer 40.

Thus, the fastener 140 is configured to engage the first wedge part 130 to wedge the first wedge part 130 between the curved alignment surface 126 of the first alignment opening 122 and the planar surface 154 of the second wedge part 134, which wedges the second side 156 of the second wedge part 134 against the first side 42 of the hammer 40. This wedges the second side 44 of the hammer 40 against the planar side 162 of the second self-aligning support member 114, which wedges the curved surface 160 of the second self-aligning support member 114 against the curved surface 128 of the second alignment opening 122 to fasten the hammer 40 within the receiving aperture 30.

Figure 11:
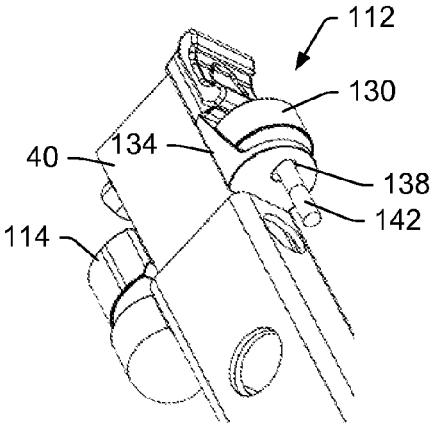
FIG. 11 is a perspective view illustrating further aspects of a self-aligning support member.

In certain embodiments, the fastener 140 that engages the first and second wedge parts 130,134 includes a bolt 142 and a nut 144. The bolt 142 extends through openings 136,138 in the first and second wedge parts 130,134, respectively, as well as through an opening 174 in a bottom plate 172 of the hammer receiver 120 and is threadably received by the nut 144. As best seen in FIG. 6 and the bottom perspective view of FIG. 11, the opening 138 of the second wedge part 134 through which the bolt 142 extends is elongated. This allows the second wedge part 134 to move laterally (side-to-side as illustrated in FIG. 6) as the first and second wedge parts 130,134 engage one another as they are drawn down by the fastener 140 and wedge the hammer 40 between the first and second self-aligning support members 112,114.

In some embodiments, the curved alignment surfaces 132, 160 of the first and second self-aligning support members 112,114 are radiused such that the first wedge part 130 and the second self-aligning support member 114 are partially cylindrical. The curved surface 126 of the first alignment opening 122 and the curved surface 132 of the first wedge part are correspondingly shaped, so that when they contact one another the planar surfaces 152,154 of the first and second wedge parts 130,134 are aligned and more fully contact one another. Similarly, when the curved surface 160 of the second self-aligning support member 114 contacts the curved alignment surface 128 of the second alignment opening 124, the planar surface 162 of the second self-aligning support member 114 aligns with and more fully contacts the planar second side 44 of the hammer 40.

In certain embodiments, the fasteners 140 and 141 further include nut retainers 180. Thus, the nut 144 is situated in the nut retainer 180, which engages the bottom plate 172 of the hammer receiver 120 when the bolt 142 is tightened within the nut 144. As shown in FIGS. 10-13, for example, the nut 144 is T-shaped and is received in a correspondingly shaped opening 182 in the nut retainer 180. In other examples, the nut 144 is not T-shaped (i.e., the nut top and bottom surfaces are generally parallel to one another) and the opening 182 is a correspondingly sized slot. The opening 182 in the nut retainer 180 extends to a flat side 184 that is situated against the sleeve 116 and welded thereto, which prevents the nut retainer 180, and thus the nut 144 situated therein, from turning as the bolt 142 is turned. Further, since the nut 144 is a loose part, it can easily be replaced if necessary, such as if the threads of the nut 144 were damaged.

FIGS. 14A-14F are simplified top views of the hammer 40, hammer receiver 120, and first and second self-aligning support members 112, 114 situated in the first and second alignment openings 122,124, respectively, conceptually illustrating various arrangements for curved alignment surfaces used in alternative embodiments. In FIGS. 14A-14F, the first or leading side 42 of the hammer 40 is on the left as shown in the drawings, and the second or trailing side 44 is on the right.

Figure 14A:
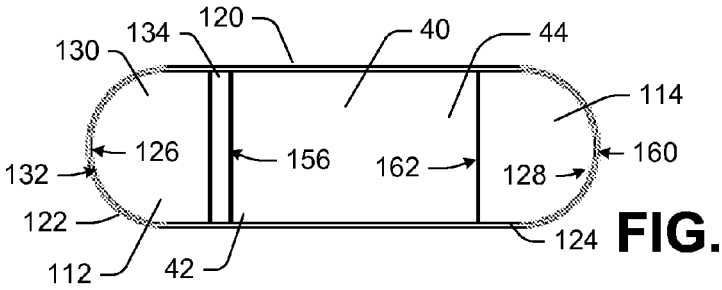
FIGS. 14A-14F conceptually illustrate examples of alternative arrangements for self-aligning support members in accordance with aspects of the present disclosure.

FIG. 14A illustrates an arrangement essentially as shown in FIG. 8 discussed above, with the first and second wedge parts 130,134 of the first self-aligning support member positioned in the first alignment opening 122 such that the curved surface 132 and the curved alignment surface 126 are positioned opposite the planar surface 156 of the second wedge part 134 that contacts the first side 42 of the hammer 40. The planar surface 162 of the second self-aligning support member 114 contacts the planar second side 44 of the hammer 40, with the curved surface 160 contacting the curved alignment surface 128.

Figure 14B:
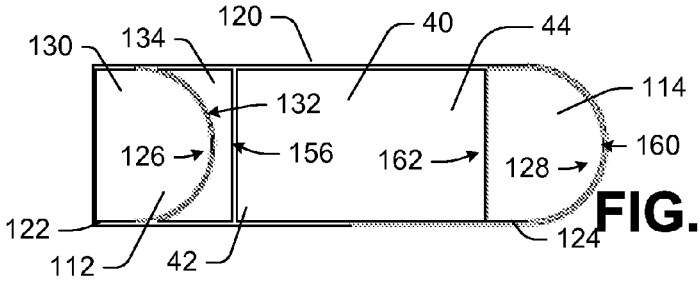

In FIG. 14B, the first and second wedge parts 130,134 are configured such that the second wedge part 134 defines the first curved alignment surface 126, which is contacted by the curved surface 132 of the first wedge part 130. Thus, the first wedge part 130 in FIG. 14B is reversed from its position shown in FIG. 14A, such that the curved surfaces 126, 132 are situated closer to the first side 42 of the hammer 40.

Figure 14C:
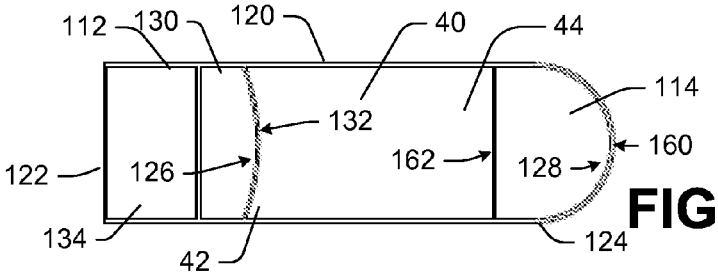

In the arrangement shown in FIG. 14C, the first side 42 of the hammer 40 defines the first curved alignment surface 126. The curved surface 132 of the first wedge part 130 is positioned adjacent the first side 42 of the hammer 40 such that the curved surface 132 contacts the first curved alignment surface 126 defined by the first side 42 of the hammer 40.

Figure 14D:
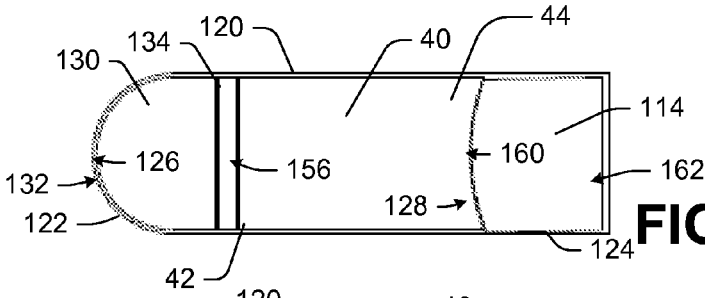

The second self-aligning support member 114 is the same in the examples shown in FIGS. 14A-14C. In FIG. 14D, the first self-aligning support member 112 is as shown in FIG. 14A, with the second self-aligning support member 114 configured such that the second curved alignment surface 128 is defined by the second side 44 of the hammer 40, which is contacted by the curved surface 160 of the second self-aligning support member 114.

Figure 14E:
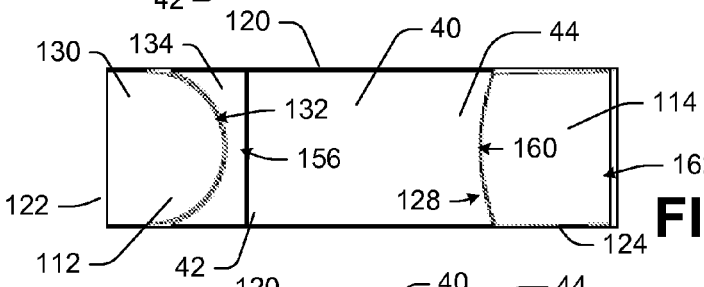
Figure 14F:
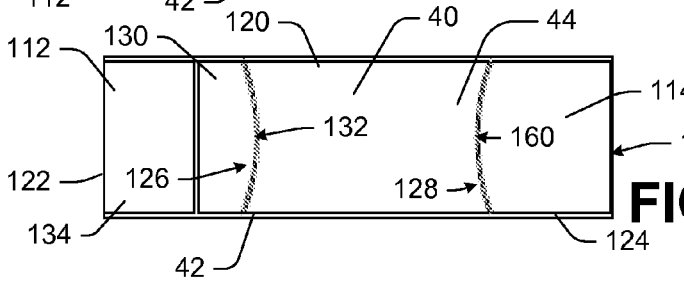

FIGS. 14E and 14F illustrate example arrangements where the second self-aligning support member 114 is as shown in FIG. 14D. In FIG. 14E, the first self-aligning support member 112 is arranged as shown in FIG. 14B, and in FIG. 14F, the first self-aligning support member 112 is arranged as shown in FIG. 14C.

Figure 15A:
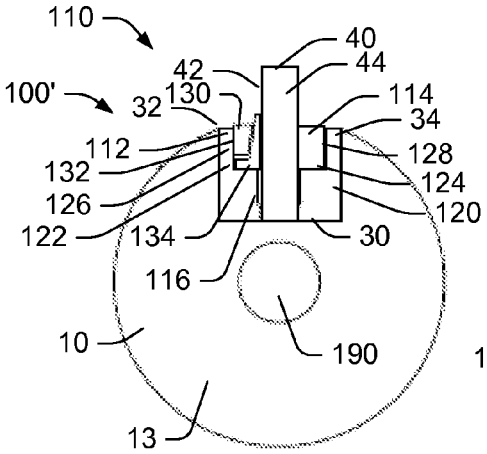
FIGS. 15A-15D illustrate an example of rotatable plates including a hammer support system for another example rotary tool in accordance with aspects of the present disclosure.

FIGS. 15A-15D illustrate aspects of other embodiments. Referring to FIG. 15A, the illustrated rotary tool 100' includes a rotatable member 10 in the form of a rotatable plate or disc 13. A hammer receiving aperture 30 is defined by the disc 13, with a hammer 40 received therein. As with examples disclosed herein above, a hammer support system 110 is provided that includes a first self-aligning support member 112 positioned between the first side 32 of the receiving aperture 30 and the first side 42 of the hammer 40. A second self-aligning support member 114 is positioned between the second side 34 of the receiving aperture 30 and the second side 44 of the hammer 40.

The hammer support system illustrated in FIGS. 15A-15D is similar to that shown in FIGS. 3-13 and described in conjunction therein, though the hammer 40 shown in FIGS. 15A-15D does not extend through the rotatable member 10. The hammer 40 is received in the receiving aperture 30 and held therein by the hammer support system 110, which includes a hammer receiver 120 that has first and second alignment openings 122, 124. A sleeve 116 is attached to the hammer receiver 120, and the hammer 40 is received in the sleeve 116. The first self-aligning support member 112 is received in the first alignment opening 122 and the second self-aligning support member 114 is received in the second alignment opening 124. As with the examples disclosed previously, the first self-aligning support member 122 includes a wedge arrangement 130,134 for clamping the hammer 40 within the receiving aperture 30. The wedge arrangement includes a fastener (such as the fastener 140 shown in FIG. 13) for drawing down a first component 130 of the wedge arrangement to clamp the hammer 40 within the receiving aperture 30. The wedge arrangement also includes a curved interface 126,132 for self-aligning the wedge arrangement as the component is drawn down by the fastener 140.

Figure 15B:
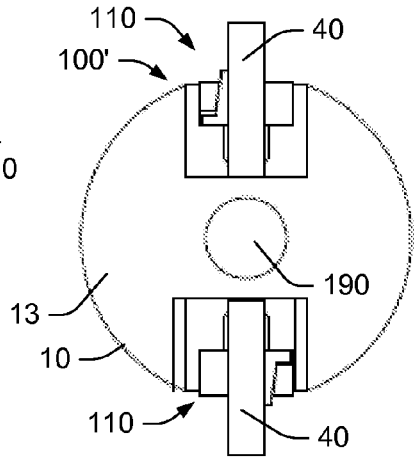
Figure 15C:
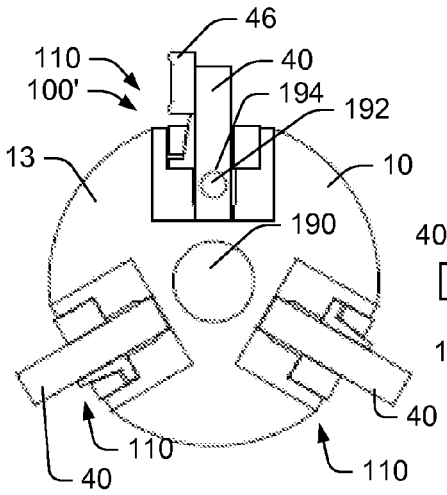
Figure 15D:
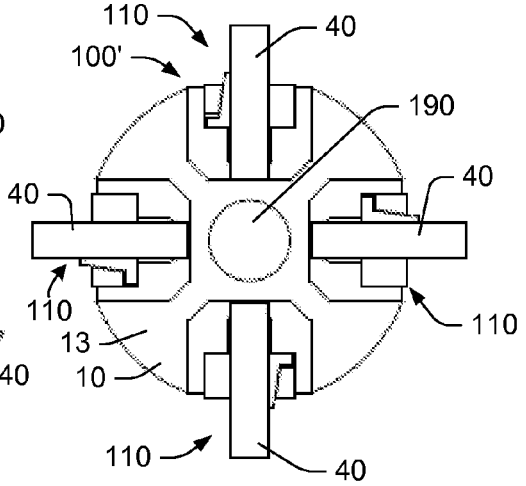

FIGS. 15B-15D illustrate further examples respectively having two, three and four hammers 40 and hammer support systems 110 received by the plate or disc 13. FIG. 16 conceptually illustrates an example rotary tool 10' employing the rotatable plates 13, which are stacked onto a central shaft 28 that extends through a central opening 190 in each of the plates 13 in a spaced-apart manner. In some embodiments, a retention pin 192 passes through a retention opening 194 (see FIG. 15C, for example) in each hammer 40 as a means of redundant retention. For simplicity of illustration, only three of the plates 13 are shown having a hammer 40 and cutter 46 attached thereto. The hammers 40 and associated hammer retention systems 110 could be in any of many configurations, such as any of the configurations shown in FIGS. 15A-15D.

Figure 16A:
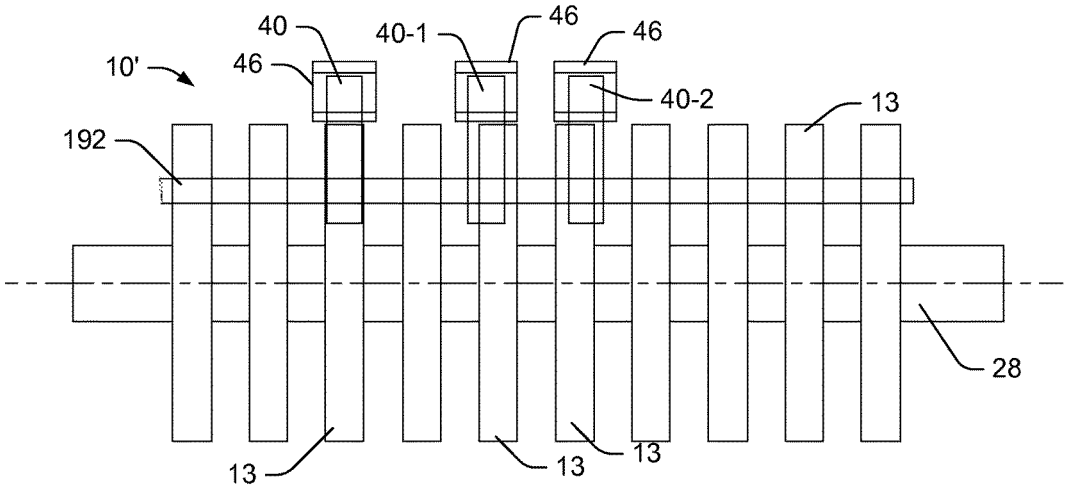
FIG. 16A is a side view conceptually illustrating an example of a rotary tool employing rotatable plates such as those shown in FIGS. 15A-15D.
Figure 16B:
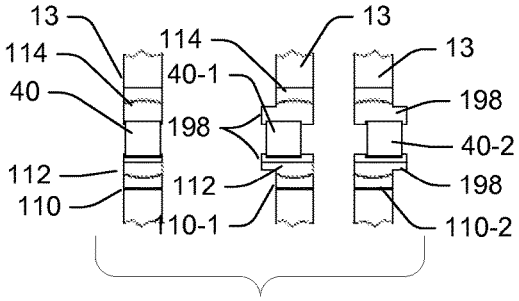
FIG. 16B is a top view illustrating examples of selected hammers and hammer support systems shown in FIG. 16A.

FIG. 16A further illustrates examples of two hammer arrangements 40-1 and 40-1, in which the hammers 40-1, 40-2 are off-set relative to the plate 13. The hammer 40-1 is off-set to the left of the corresponding plate 13 and the hammer 40-2 is off-set to the right of the corresponding plate 13 as illustrated in FIG. 16A. FIG. 16B is a top view of the example hammers 40, 40-1, 40-2 shown in FIG. 16A. As disclosed herein above, the hammers 40, 40-1, 40-2 are held in the receiving apertures 30 by corresponding hammer retention systems 110, 110-1, 110-2. The modified hammer retention systems 110-1, 110-2 shown in FIG. 16B include the wedge arrangement having the curved alignment surfaces described herein, and are further configured such that the first and second self-aligning support members 112, 114 include extended portions 198 to receive the hammers 40-1,40-2 in an off-set manner.

FIGS. 17-21 illustrate various aspects of an example of an alternative hammer support system 110*a*, in which self-aligning support members 112*a*, 114*a* are situated at an angle relative to the longitudinal axis of the hammer 40. In the example shown in FIGS. 17-21, the first and second self-aligning support members 112*a*, 114*a* situated on the first and second sides 42, 44 of the hammer 40 have the same structure. Each of the first and second self-aligning support members 112*a*, 114*a* include a single wedge part 130*a* that is received in respective alignment openings 122*a*, 124*a* in a hammer receiver 120*a*.

As with earlier-disclosed examples, the first alignment opening 122*a* has a curved alignment surface 126*a* and the second alignment opening 124*a* has a curved alignment surface 128*a*. In the example shown in FIG. 19, the curved alignment surfaces 126*a*,126*b* are angled relative to the longitudinal axis of the hammer 40, which is represented by a vertical dashed line 210 extending vertically in FIG. 19. The angle of the alignment surfaces 126*a*,126*b* is indicated by a dashed line 212 that extends at an angle as compared to the line 210. In other words, the alignment surfaces 126*a*,126*b* are not parallel to the axis of the hammer 40.

Figure 18:
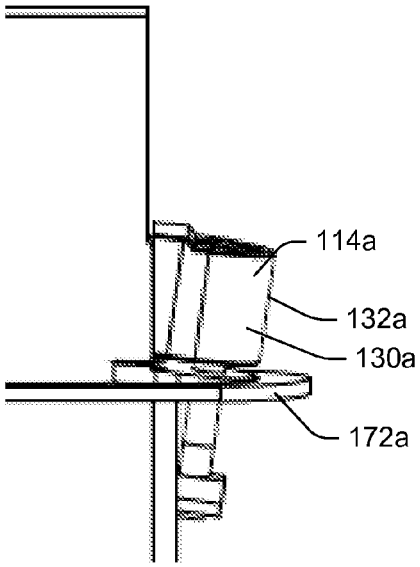
FIG. 18 is a close up view of portions of the hammer and hammer support system shown in FIG. 17.
Figure 19:
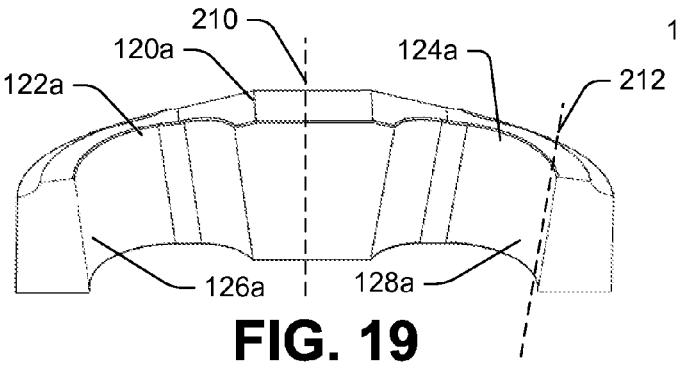
FIG. 19 is a sectional view of an example a hammer receiver in accordance with the hammer support system shown in FIGS. 17 and 18.
Figure 21:
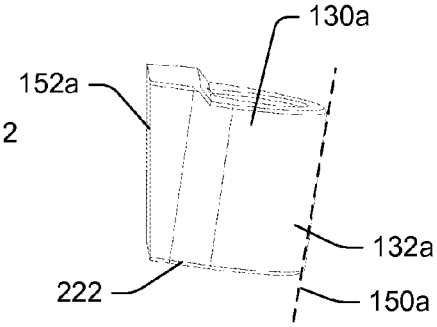
FIG. 21 is a perspective view of an example wedge part in accordance with the hammer support system shown in FIGS. 17 and 18.

The first and second self-aligning support members 112*a*, 114*a* each include a first wedge part 130*a* that has a curved surface 132*a* and a planar surface 152*a* opposite the curved surface 132*a* that is configured to mate with sides of the hammer 40. As best shown in FIGS. 18 and 21, the curved surface 132*a* of the first wedge part 130*a* and the planar surface 152*a* are not parallel to one another. As shown in FIG. 18, the planar surface 152 is configured to mate with the side of the hammer 40. Each of the wedge parts 130*a* of the first and second self-aligning support members 112*a*, 114*a* defines a projection line 150*a* that is angled relative to the planar surface 152*a*. The angle of the projection line 150*a* relative to vertical is about the same as the angle of the curved alignment surfaces 126*a*, 128*a* as indicated by the line 212.

Figure 20:
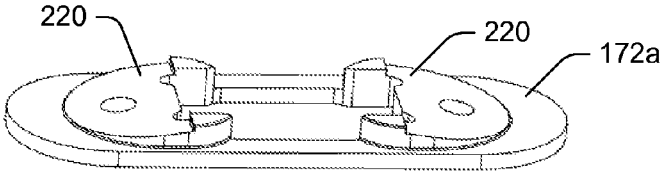
FIG. 20 is a perspective view of an example of a bottom plate in accordance with the hammer support system shown in FIGS. 17-19.

FIG. 20 shows an example bottom plate 172*a* of the hammer receiver 120*a*. In the examples shown in FIGS. 3-7, the bottom plate 172 of the hammer receiver 120 has a generally planar top surface. The bottom plate 172 shown in FIG. 20 includes tabs 220 that extend upwardly from the bottom plate 172 to form a surface situated at approximately a right angle relative to the projection line 212 and generally parallel with a bottom surface 222 of the wedge part 130*a*.

Figure 17:
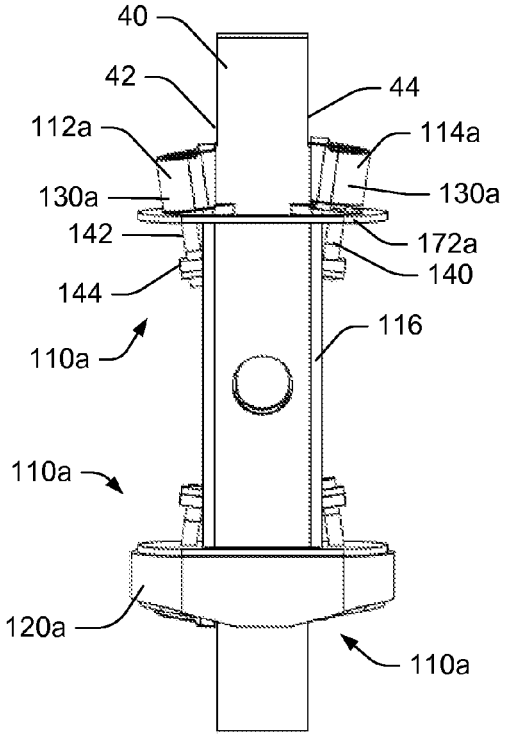
FIG. 17 is a side view illustrating aspects of another example of a hammer and hammer support system in accordance with the present disclosure.

FIG. 17 illustrates the hammer support system 110*a* with the hammer receiver 120 removed in the upper portion of the drawing to show the position of the wedge parts 130*a* of the first and second self-aligning hammer supports. The hammer support system 110*a* shown in the lower part of FIG. 17 is identical to that illustrated at the upper part of the drawing. Referring to the first self-aligning support member 112*a* shown on the left side of the upper portion of FIG. 17, the wedge part 130*a* is inserted into the alignment opening 122*a* of the hammer receiver 120*a* such that planar surface 152*a* thereof is situated against the first side 42 of the hammer 40. A fastener 140 including a bolt 142 threadably received in a nut 142 is tightened to draw the wedge part 130 of the first self-aligning support member 112*a* down against one of the tabs 220 of the bottom plate 172*a*. The curved surface 126*a* of the first alignment opening 122*a* and the curved surface 132*a* of the first self-aligning support member 112*a* contact one another to self-align the wedge part 130*a*. Note that the bolt 142 is angled relative to the axis of the hammer 40, such that the bolt extends generally parallel to the projection lines 212 and 150*a*. As with earlier-disclosed examples, the nut 144 may be received in a nut retainer 180 fasted to the sleeve 116. The nut retainer is not shown in FIGS. 17-21 for clarity.

The wedge part 130*a* of the second self-aligning support member 114*a* is then situated in the second alignment opening 124*a* such that the planar surface 152*a* thereof contacts the second side 44 of the hammer 40, and the curved surface 132*a* contacts the curved alignment surface 128*a* of the second alignment opening 124*a*. The hammer receiver 120*a* is sized such that when the wedge part 130*a* of the second self-aligning support member 114*a* is received in the second alignment opening 124*a*, the wedge part 130*a* does not extend to all the way to the tab 220 below the second alignment opening 124*a*. As the fastener 140 of the second self-aligning member 114*a* is tightened, the wedge part 130*a* is drawn downward so that the wedge part 130*a* wedged between the side 44 of the hammer 40 and the second alignment surface 128*a*, pushing the first side 42 of the hammer tighter against the wedge part 130*a* of the first self-aligning support member 112*a*. In the example shown in FIGS. 17-21, the hammer receiver 120*a* is sized such that, even when tightened, the fastener 140 for the second self-aligning support member 114*a* does not draw the wedge part 130*a* thereof against the bottom plate 172, as shown in FIGS. 17 and 18.

Figure 22:
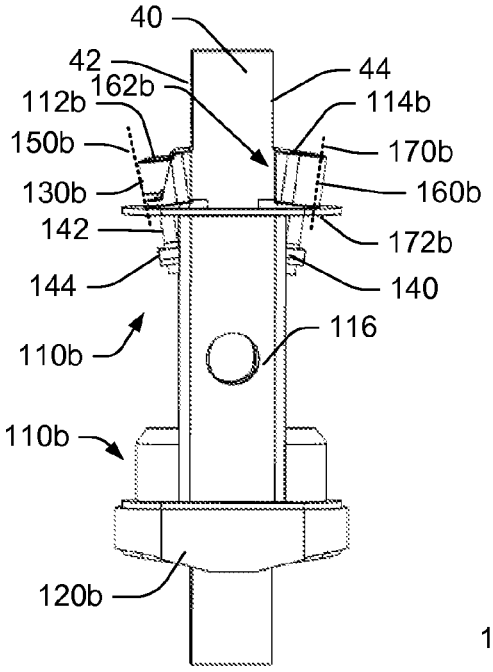
FIG. 22 is a side view illustrating aspects of another example of a hammer and hammer support system in accordance with the present disclosure.
Figure 23:
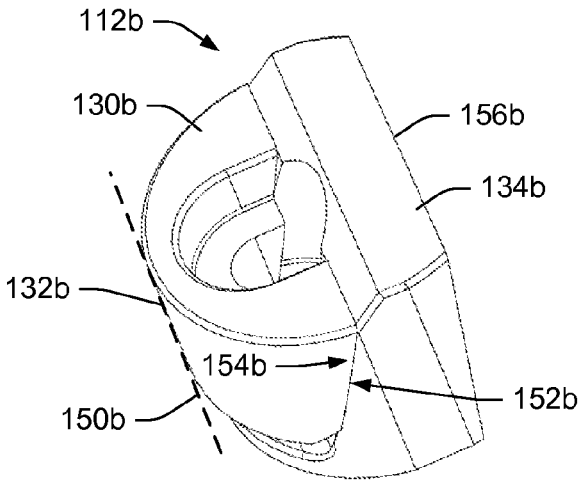
FIG. 23 is a perspective view of a self-aligning support member in accordance with the hammer support system shown in FIG. 22.
Figure 24:
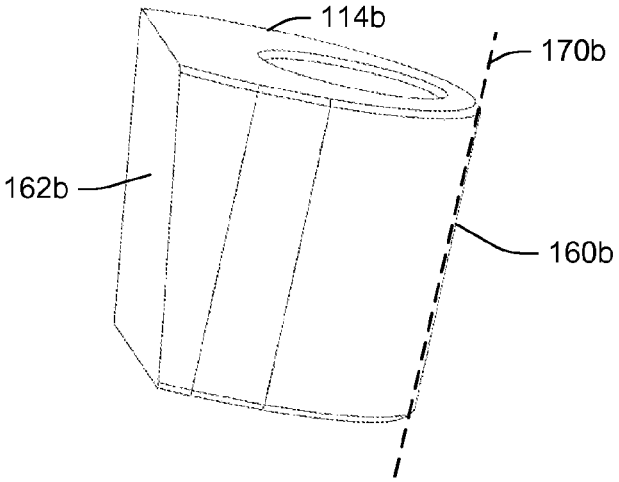
FIG. 24 is a perspective view of another self-aligning support member in accordance with the hammer support system shown in FIG. 22.

FIGS. 22-24 illustrate an example of another hammer support system 110*b* in which self-aligning support members include planar surfaces that mate with sides of the hammer 40, and curved alignment surfaces that extend at an angle to (i.e. not parallel to) the planar surfaces. Similarly to the example shown in 17-21, the hammer support system 110*b* shown in FIGS. 22-24 has self-aligning support members 112*b*, 114*b* that are situated at an angle relative to the longitudinal axis of the hammer 40. In the system 110*b*, however, the first and second self-aligning support members 112*b*, 114*b* situated on the first and second sides 42, 44 of the hammer 40, respectively, have different structures.

The first and second self-aligning support members 112*b*, 114*b* are received in respective alignment openings 122*b*, 124*b* in a hammer receiver 120*b*. The hammer receiver 120*b* is configured similarly to the hammer receiver 120*a* shown in FIG. 19, and the bottom plate 172*b* of the hammer receiver 120*b* is also similar to the bottom plate 172*a* shown in FIG. 20. These items are therefore not discussed in detail regarding the hammer retention system 110*b*.

Referring to FIG. 23, the first self-aligning support member 112*b* includes a first wedge part 130*b* having a curved surface 132*b* defining a projection line 150*b*, and a planar surface 152*b* that is angled relative to the projection line 150*b* of the curved surface 132*b*. The first self-aligning support member 112*b* further includes a second wedge part 134*b* with a planar surface 154*b* that is configured to mate with the planar surface 152*b* of the first wedge part 130*b*. The second wedge part 134*b* further includes a second side 156*b* that mates with the first side 42 of the hammer 40. As best shown in FIG. 22, the projection line 150*b* is angled, or not parallel to, the vertical longitudinal axis of the hammer 40.

An example of the second self-aligning support member 114*b* is illustrated in FIG. 24. The second self-aligning support member 114*b* has a planar surface 162*b* configured to mate with the second side 44 of the hammer 40. Opposite the planar surface 162*b* is a curved alignment surface 160*b* that is configured to contact the second curved alignment surface of the hammer receiver 120*b*. The curved alignment surface 160*b* defines a projection line 170*b* that, as best shown in FIG. 22, is angled (not parallel to) the longitudinal axis of the hammer 40. In other words, the projection line 170*b* is not parallel to the planar surface 162*b* of the second self-aligning support member 114*b*. As with the earlier-disclosed embodiments, the curved surfaces 132*b* and 160*b* contact the respective curved alignment surfaces of the hammer receiver 120*b* to pivot relative to one another and thereby self-align the first and second self-aligning support members 112*b*,114*b* as the respective fasteners 140 are tightened.

Various modifications and alterations of this disclosure may become apparent to those skilled in the art without departing from the scope and spirit of this disclosure, and it should be understood that the scope of this disclosure is not to be unduly limited to the illustrative examples set forth herein.

What is claimed is:

1. A rotary tool, comprising:
a rotatable member including a receiving aperture having a first side and a second side;
a hammer positioned in the receiving aperture having a first side and a second side;
a hammer receiver including a first alignment opening;
a first self-aligning support member positioned between the first side of the receiving aperture and the first side of the hammer, wherein the first self-aligning support member is received in the first alignment opening; and
a second self-aligning support member positioned between the second side of the receiving aperture and the second side of the hammer.

2. The rotary tool of claim 1, wherein:
the first alignment opening has a first curved alignment surface;
the first self-aligning support member has a second curved alignment surface; and
the first and second alignment surfaces matingly contact one another.

3. The rotary tool of claim 2, wherein the first alignment surface is situated between the first self-aligning support member and the hammer.

4. The rotary tool of claim 1, wherein:
the first alignment opening has a first alignment surface;
the first side of the hammer has a second alignment surface; and
the first and second alignment surfaces contact one another.

5. The rotary tool of claim 1, wherein:
the first alignment opening has a curved alignment surface;
the first self-aligning support member includes a first wedge part having a curved surface defining a projection line, and a planar surface that is angled relative to the projection line of the curved surface, and a second wedge part having a planar surface configured to mate with the planar surface of the first wedge part and a second side configured to mate with the first side of the hammer; and
the curved surface of the first alignment opening and the curved surface of the first self-aligning support member pivot into alignment relative to each other when brought into contact one another.

6. The rotary tool of claim 5, wherein:
the projection line extends generally parallel with a longitudinal axis of the hammer.

7. The rotary tool of claim 1, wherein:
the first alignment opening has a curved alignment surface;

the first self-aligning support member includes a first wedge part having a curved surface defining a projection line, and a planar surface opposite the curved surface configured to mate with the first side of the hammer; and the curved surface of the first alignment opening and the curved surface of the first self-aligning support member pivot into alignment relative to each other when brought into contact with one another.

8. The rotary tool of claim 2, wherein:

the second self-aligning support member is positioned between the second side of the receiving aperture and the second side of the hammer, the second self-aligning support member having a third alignment surface;

the hammer receiver includes a second alignment opening having a fourth alignment surface;

the second self-aligning support member being received in the second alignment opening; and the third and fourth alignment surfaces contact one another.

9. The rotary tool of claim 8, wherein:

the first and second alignment openings each have a curved alignment surface;

the first self-aligning support member includes a first wedge part having a curved surface defining a projection line extending generally parallel with a longitudinal axis of the hammer and a planar surface that is angled relative to the projection line of the curved surface, and a second wedge part having a planar surface configured to mate with the planar surface of the first wedge part and a second side configured to mate with the first side of the hammer;

the second self-aligning support member includes a curved surface defining a projection line extending generally parallel with the longitudinal axis of the hammer and a planar surface extending generally parallel with the projection line of the curved surface, the planar surface of the second self-aligning support member being configured to mate with the second side of the hammer;

the curved surface of the first alignment opening and the curved surface of the first self-aligning support member contact one another; and the curved surface of the second alignment opening and the curved surface of the second self-aligning support member contact one another.

10. The rotary tool of claim 9, further comprising:

a fastener configured to engage the first wedge part to wedge the first wedge part between the curved alignment surface of the first alignment opening and the planar surface of the second wedge part, which wedges the second side of the second wedge part against the first side of the hammer, which wedges the second side of the hammer against the planar side of the second self-aligning support member, which wedges the curved surface of the second self-aligning support member against the curved surface of the second alignment opening.

11. The rotary tool of claim 10, wherein the fastener includes:

a bolt extending through openings in the first and second wedge parts, wherein the bolt defines an axis extending generally parallel to a longitudinal axis of the hammer.

12. The rotary tool of claim 1, wherein the rotatable member is a drum configured to rotate about an axis.

13. The rotary tool of claim 1, wherein the rotatable member is a plate configured to rotate about an axis.

14. The rotary tool of claim 1, further comprising a cutter attached to the hammer.

15. The rotary tool of claim 1, wherein at least one of the first and second self-aligning support members includes a wedge arrangement for clamping the hammer within the receiving aperture, the wedge arrangement including a fastener for drawing down a component of the wedge arrangement to clamp the hammer within the receiving aperture, the wedge arrangement also including a curved interface for self-aligning the wedge arrangement as the component is drawn down by the fastener.

16. A hammer support system, comprising:

a hammer receiver including a first alignment opening having a first curved alignment surface;

a first wedge part having a curved surface;

a second wedge part configured to interact with the first wedge part; and a fastener for drawing down the first wedge part against the second wedge part such that the curved surface of the first wedge part engages the first curved alignment surface to self-align the first and second wedge parts as the first wedge part is drawn down by the fastener.

17. The hammer support system of claim 16, wherein:

the curved surfaced of the first wedge part defines a projection line;

the first wedge part includes a planar surface that is angled relative to the projection line;

the second wedge part includes a planar surface configured to mate with the planar surface of the first wedge part.

18. The hammer support system of claim 16, further comprising a second self-aligning support member, which includes:

a curved surface defining a projection line extending generally parallel with a longitudinal axis of the hammer;

a planar surface extending generally parallel with the projection line of the curved surface, the planar surface of the second self-aligning support member being configured to mate with the second side of the hammer; and the curved surface of the second alignment opening and the curved surface of the second self-aligning support member contact one another.

19. A method of fastening a hammer in a rotary tool, comprising:

providing a hammer receiver including a first alignment opening having a first curved alignment surface;

situating a hammer in the hammer receiver;

tightening a fastener so as to draw down a first wedge part against a second wedge part such that a curved surface of the first wedge part engages the first curved alignment surface to self-align the first and second wedge parts as the first wedge part is drawn down, and such that a second side of the second wedge part mates with a first side of the hammer to fasten the hammer in the hammer receiver.

* * * * *